US006215842B1

(12) United States Patent
Resnick et al.

(10) Patent No.: US 6,215,842 B1
(45) **Date of Patent: *Apr. 10, 2001**

(54) REDUCTION OF TEMPORAL VARIATIONS IN X-RAY RADIATION

(76) Inventors: Theodore A. Resnick, 23908 Cedar Rd., Beachwood, OH (US) 44122; Rodney A. Mattson, 6532 Melshore Dr., Mentor, OH (US) 44060

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/132,800

(22) Filed: Aug. 13, 1998

(51) Int. Cl.[7] ..... H05G 1/34
(52) U.S. Cl. ..... 378/16; 378/112; 378/98.7
(58) Field of Search ..... 378/16, 98.7, 112

(56) References Cited

U.S. PATENT DOCUMENTS 2,503,075 * 4/1950 Smith ..... 378/112
5,530,735 * 6/1996 Gard et al. ..... 378/112

* cited by examiner

*Primary Examiner*—Craig E. Church

(57) ABSTRACT

An x-ray radiation stabilization system is provided including an x-ray tube (20) which emits x-ray radiation (22). The x-ray tube (20) has an anode (52), a cathode (50), and a vacuum envelope (54) which houses the anode (52) and the cathode (50). A high-voltage generator (40) is connected to the x-ray tube (20). It supplies a high-voltage electric potential between the cathode (50) and anode (52) such that an electron beam flows therebetween. The electron beam strikes the anode (52) producing the x-ray radiation (22). A reference radiation detector (60) samples a representative portion of the x-ray radiation (22) emitted by the x-ray tube (20) and generates an error signal in response to an intensity of the sampled x-ray radiation (22). A feedback circuit (80) is connected between the reference radiation detector (60) and the high-voltage generator (40). The feedback circuit (80) processes the error signal and in response thereto directs the high-voltage generator (40) to adjust the high-voltage electric potential supplied to the x-ray tube (20) so that in the x-ray radiation (22) ripple having a predetermined frequency range is substantially canceled.

18 Claims, 2 Drawing Sheets

REDUCTION OF TEMPORAL VARIATIONS IN X-RAY RADIATION

BACKGROUND OF THE INVENTION

The present invention relates to the art of x-ray generation and/or production. It finds particular application in conjunction with CT scanners, and will be described with particular reference thereto. However, it is to be appreciated that the present invention is also amenable to other like applications where temporally stable x-ray generation is desired.

Generally, CT scanners have a defined examination region or scan circle in which a patient or other subject being imaged is disposed. A beam of radiation is transmitted across the examination region from an x-ray source, such as an x-ray tube, to oppositely disposed radiation detectors. The source, or beam of radiation, is rotated around the examination region while data is collected from the radiation detectors receiving x-ray radiation passing through the examination region.

The sampled data is typically manipulated via appropriate reconstruction processors to generate an image representation of the subject which is displayed in a human-viewable form. Commonly, the x-ray data is transformed into the image representation utilizing filtered backprojection. A family of rays extending from source to detector is assembled into a view. Each view is filtered or convolved with a filter function and backprojected into an image memory. Various view geometries have been utilized in this process. In one example, each view is composed of the data corresponding to rays passing parallel to each other through the examination region, such as from a traverse and rotate-type scanner. In a rotating, fan-beam-type scanner in which both the source and detectors rotate (i.e. a third generation scanner), each view is made up of concurrent samplings of an arc of detectors which span the x-ray beam when the x-ray source is in a given position to produce a source fan view. Alternately, with stationary detectors and a rotating source (i.e. a fourth generation scanner), a detector fan view is formed from the rays received by a single detector as the x-ray source passes behind the examination region opposite the detector.

The demands placed on a x-ray tube by a CT scanner are quite severe. For example, in a rotating anode x-ray tube, a heavy metal or metal/graphite anode, in an evacuated x-ray tube, is spun on its axis at angular velocities of 60 to 180 revolutions per second. The x-ray tube, in turn, is rotated at angular speeds up to 2 revolutions per second on the CT scanner's rotating gantry. The "G" forces are quite high. Moreover, it is generally advantageous that the x-ray tube generate a steady, high-power x-ray flux that is without temporal and spatial fluctuations. However, temporal x-ray variations or x-ray ripple often exist and come from sources such as: anode target surface roughness and density; filament vibration or the resonant frequency of the filament; cathode vibration or the resonance frequency of the cathode mounting structure; and, other effects that cause the beam current to vary.

Fourth generation CT scanners reconstruct temporally varying x-ray beams into images with "tire track" artifacts. The nature of the artifacts vary with the x-ray ripple frequency (typically, very high or very low x-ray ripple frequencies of reasonable magnitudes do not materially contribute to image artifacts), detector sampling rate, and gantry rotational speed.

Methods to compensate for the presence of time varying x-ray CT data have been developed. The methods generally involve the use of reference detectors somewhere on the gantry. The output of the reference detectors is used by the computational systems and/or reconstruction processors to correct for variations in the x-ray data. However, fast, high-quality CT scans employ multiple detectors and high quantities of data. Burdensome corrections and/or data conditioning by software for x-ray ripple artifacts in the data results in slower, more inefficient reconstruction processing.

One method for the correction of temporal variations (ripple) of the x-ray beam has been to utilize data from the radiation detectors that are active, but are out of the imaging field. These detectors "see" the same temporal x-ray variations as the more central imaging detectors. The data from these reference detectors is used to make corrections to the data from the imaging detectors and remove the undesirable effects before the image reconstruction process. The detectors, both imaging and reference, are located opposite the x-ray source, and beyond the object or patient being scanned with the reference detector being at the far left and right sides of the fan beam. An inherent drawback of this system is that on occasion, the patient or appurtenances to the patient (tubes, clothes, sheets, etc.) may interrupt the reference portions of the x-ray beam, invalidating the data from these reference detectors. Therefore, the software is further burdened by having to recognize invalid data and not apply it for corrections.

The present invention contemplates new and improved x-ray generation techniques which overcome the above-referenced problems and others.

SUMMARY OF THE INVENTION

In accordance with one aspect of the present invention, an x-ray radiation stabilization system is provided. It includes an x-ray tube which emits x-ray radiation. The x-ray tube includes an anode, a cathode, and a vacuum envelope housing the anode and the cathode. A high-voltage generator is connected to the x-ray tube which supplies a high-voltage electric potential between the cathode and anode such that an electron beam flows therebetween striking the anode to produce the x-ray radiation. A reference radiation detector samples a representative portion of the x-ray radiation emitted by the x-ray tube and generates a signal in response to an intensity of the sampled x-ray radiation. A feedback circuit is connected between the reference radiation detector and the high-voltage generator. The feedback circuit generates an error signal in response to the detected radiation and directs the high-voltage generator to adjust the high-voltage electric potential supply to the x-ray tube such that in the x-ray radiation ripple having a predetermined frequency range is substantially canceled.

In accordance with a more limited aspect of the present invention, the x-ray radiation stabilization system further includes a radiation filter disposed in front of the reference radiation detector which filters the x-ray radiation before it is sampled by the reference radiation detector.

In accordance with a more limited aspect of the present invention, the radiation filter is selectively tunable.

In accordance with a more limited aspect of the present invention, the radiation filter is tuned to achieve a spectral response to the sampled x-ray radiation which simulates that of a subject being examined with the x-ray radiation.

In accordance with a more limited aspect of the present invention, the feedback circuit includes an amplifier which amplifies the error signal.

In accordance with a more limited aspect of the present invention, the feedback circuit further includes a normalization circuit which normalizes gain from the amplifier.

In accordance with a more limited aspect of the present invention, the feedback circuit further includes a band-pass filter through which the error signal is passed to substantially remove frequency components outside the predetermined frequency range.

In accordance with a more limited aspect of the present invention, the feedback circuit corrects for filtering effects a subject being examined has on an energy spectrum of the x-ray radiation.

In accordance with a more limited aspect of the present invention, the predetermined frequency range is from about 30 Hz to about 700 Hz.

In accordance with a more limited aspect of the present invention, the reference radiation detector samples the x-ray radiation prior to its traversing a subject being examined by the x-ray radiation.

In accordance with another aspect of the present invention, an x-radiation system for the reduction of x-ray ripple is provided in a CT scanner. The CT scanner includes a stationary gantry portion which defines an examination region in which a subject being examined is placed, a rotating gantry portion mounted to the stationary gantry portion for rotation about the examination region, an x-ray source arranged on the rotating gantry portion such that x-ray radiation emitted therefrom passes through the examination region as the rotating gantry portion rotates, an array of imaging radiation detectors arranged to receive the x-ray radiation emitted from the x-ray source after it has traversed the examination region, a reconstruction processor for reconstructing images of the subject from data generated by the imaging radiation detectors, and a human-viewable display for displaying the reconstructed images. The x-ray radiation system includes a high-voltage generator connected to the x-ray source for supplying a high-voltage electric potential thereto. A reference radiation detector samples the x-ray radiation emitted and generates a signal in response thereto. A feedback circuit is connected between the reference detector and the high-voltage generator. The feedback circuit generates an error signal in response to the signal generated by the reference radiation detector and directs the high-voltage generator to adjust the high-voltage electric potential such that in the x-ray radiation ripple having a predetermined frequency range is substantially canceled.

In accordance with a more limited aspect of the present invention, the reference radiation detector is located in a path of the x-ray radiation prior to its traversing the examination region.

In accordance with a more limited aspect of the present invention, one of the array of imaging radiation detectors which is receiving x-ray radiation that has not traversed the examination regions functions as the reference radiation detector.

In accordance with a more limited aspect of the present invention, the x-ray radiation system further includes a radiation filter positioned in front of the reference radiation detector. The radiation filter filters the x-ray radiation before it is sampled by the reference radiation detector such that a response substantially similar to that of x-ray radiation passing through the subject is achieved.

In accordance another aspect of the present invention, a method of reducing ripple in x-ray radiation is provided. It includes generating a high-voltage electrical potential and applying the high-voltage electrical potential to an x-ray source to generate x-ray radiation. The x-ray radiation is then sampled. An error signal in response to the sampled x-ray radiation is generated which is indicative of ripple in the x-ray radiation. The high-voltage electrical potential is regulated in response to the error signal such that the ripple in the x-ray radiation is substantially canceled.

In accordance with a more limited aspect of the present invention, the method further includes filtering the x-ray radiation prior to it being sampled. The x-ray radiation is filtered to simulate a response substantially similar to that of traversing a subject being examined with the x-ray radiation.

In accordance with a more limited aspect of the present invention, the ripple in the x-ray radiation that is substantially canceled falls within a predetermined frequency range.

In accordance with a more limited aspect of the present invention, the predetermined frequency range is from about 30 Hz to about 700 Hz.

One advantage of the present invention is the extension of x-ray tube life by allowing aging tubes to remain in service longer without producing imaging artifacts associated with x-ray ripple.

Another advantage of the present invention is an increase in x-ray tube manufacturing yield by the easing of tolerance criteria.

Another advantage of the present invention is increased reconstruction processing speed due to the reduction of the amount of time and effort employed in radiation variation correction.

Another advantage of the present invention is the reduction of image artifacts caused by ripple in the x-ray radiation.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
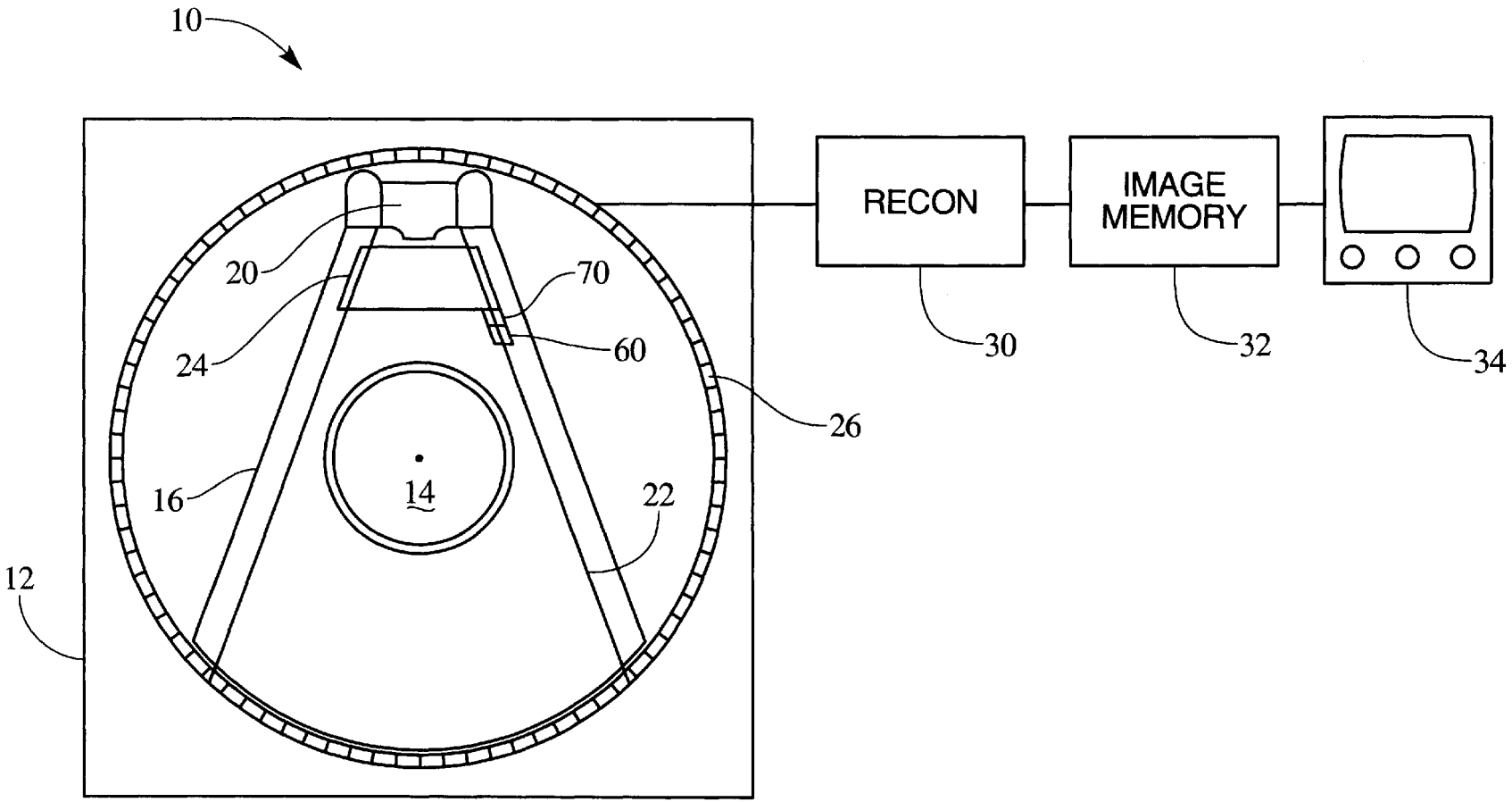
FIG. 1 is a diagrammatic illustration of a CT scanner in accordance with aspects of the present invention; and, FIG. 2 is a diagrammatic illustration of an x-ray radiation stabilization system in accordance with aspects of the present invention.

With reference to FIG. 1, a CT scanner 10 includes a stationary gantry portion 12 which defines an examination region 14 in which a subject being examined is placed. A rotating gantry portion 16 is mounted on the stationary gantry portion 12 for rotation about the examination region 14. An x-ray source, such as an x-ray tube 20, is arranged on the rotating gantry portion 16 such that a beam of x-ray radiation 22 passes through the examination region 14 as the rotating gantry portion 16 rotates. A collimator assembly 24 forms the beam of radiation 22 into a thin fan-shaped beam and optionally includes a shutter that selectively gates the beam 22 on and off. Alternately, the fan-shaped radiation beam 22 may also be gated on and off electronically at the x-ray source.

In the illustrated fourth generation CT scanner, a ring of imaging radiation detectors 26 are mounted peripherally around the examination region 14 on the stationary gantry portion 12. Alternately, as in a third generation CT scanner, the imaging radiation detectors 26 may be mounted on the rotating gantry portion 16 on a side of the examination region 14 opposite the x-ray tube 20 such that they span an arc defined by the fan-shaped x-ray beam 22. Regardless of the configuration, the imaging radiation detectors 26 are arranged to receive the x-ray radiation 22 emitted from the x-ray tube 20 after it has traversed the examination region 14.

In a source-fan geometry, an arc of imaging radiation detectors 26 which span the x-ray radiation 22 emanating from the x-ray tube 20 are sampled concurrently at short time intervals as the x-ray tube 20 rotates behind the examination region 14 to generate a source-fan view. In a detector-fan geometry, each imaging radiation detector 26 is sampled a multiplicity of times as the x-ray tube 20 rotates behind the examination region 14 to generate a detector-fan view. The path between the x-ray tube 20 and each of the imaging radiation detectors 26 is denoted as a ray.

The imaging radiation detectors 26 convert the detected radiation into electronic data. That is to say, each of the imaging radiation detectors 26 produces an output signal which is proportional to an intensity of received radiation. The data from the imaging radiation detectors 26 is reconstructed into an image representation of the subject being examined by an imaging or reconstruction processor 30 which implements a conventional reconstruction algorithm, such as a convolution and filtered backprojection algorithm. The image representations are stored in an image memory 32 where they are selectively accessed for viewing on a human-viewable display 34, such as a video monitor.

Figure 2:
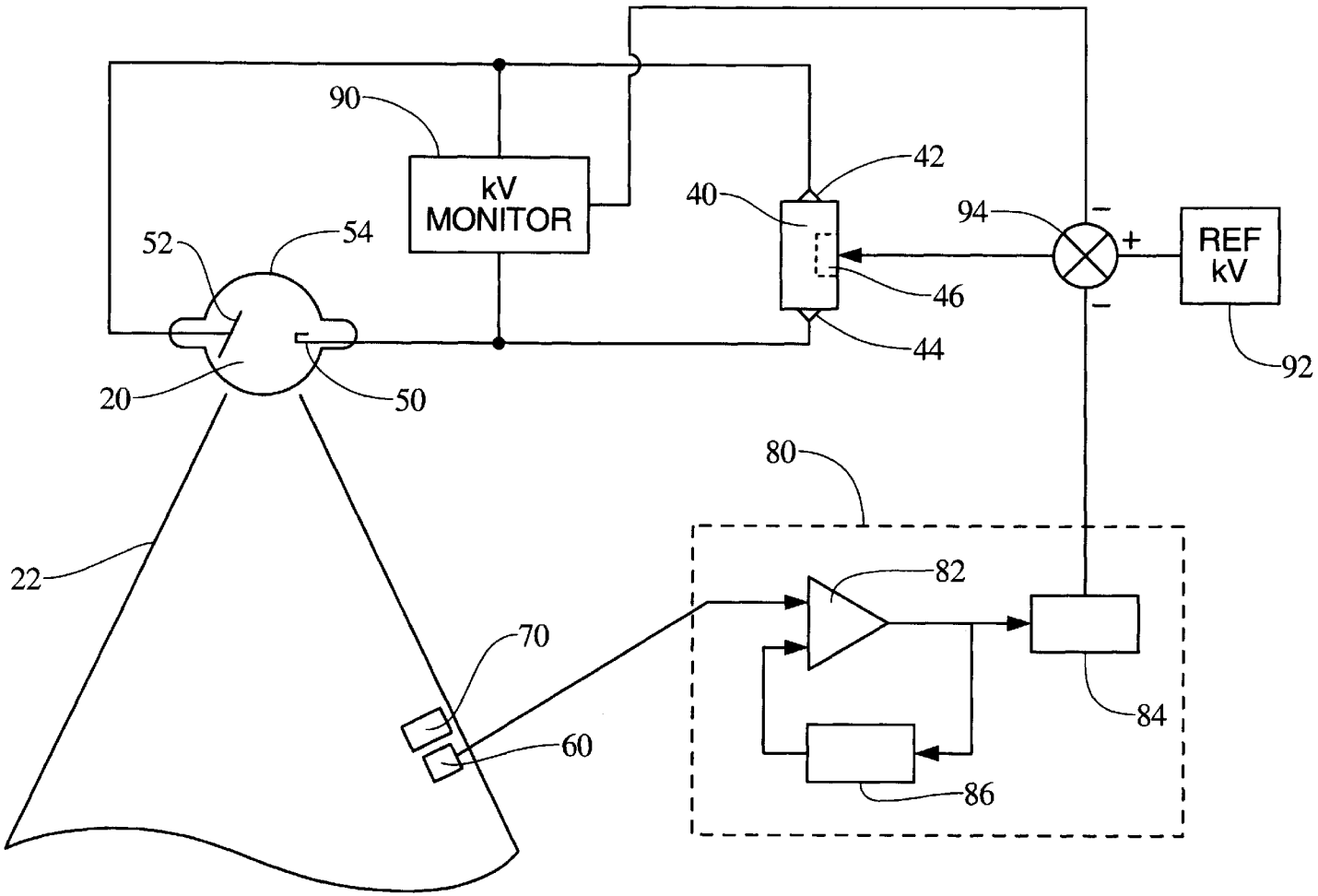

With reference to FIG. 2 and continuing reference to FIG. 1, a high-voltage generator 40 produces a high-voltage output, positive at a first or anode output 42 and negative at a second or cathode output 44. The high-voltage generator 40 includes a milliamp (mA) control (not shown) and a kilovolt (kV) control 46 to adjust the electrical potential at the output. The outputs 42 and 44 are connected to the x-ray tube 20 and supply a high-voltage electric potential thereto. The x-ray tube 20 includes an electron source or cathode 50 such as a filament which is heated by a filament-heating current from a filament current source (not shown). The heated filament generates a cloud of electrons which are drawn to a target electrode or anode 52 by the potential applied by the high-voltage generator 40 across the cathode 50 and the anode 52 to form an electron beam. When the electron beam impacts the target or anode 52, the beam of x-ray radiation 22 is generated. The anode or target 52 and electron source or cathode 50 are sealed in a vacuum envelope 54. The intensity of the x-ray radiation 22 produced is proportional to the square or higher power of the electrical potential applied by the high-voltage generator 40 among other factors.

A reference radiation detector 60 samples a representative portion of the x-ray radiation 22 emitted by the x-ray tube 20 which has not traversed the examination region 14 and generates a signal in response to an intensity of the sampled x-ray radiation 22. That is, the reference radiation detector 60 detects the ripple in the x-ray radiation 22. In a preferred embodiment, the reference radiation detector 60 is a rectangular sensor mounted on the collimator assembly 24. The active area of the reference radiation detector 60 has a narrow dimension and is arranged such that it sees only umbral radiation from the x-ray focal spot. Radiation within the penumbra is not used as it may contain spatial modulations caused by focal spot walking due to imperfections in the rotation of a rotating anode and/or in the focal track. Additionally, the collimator assembly 24 is designed such that x-ray-absorbing edge material is not interposed between the x-ray focal spot and the collimator mounted reference radiation detector 60. Edge materials in the beam tend to act as optical levers, magnifying spot motion and potentially cutting off part of the umbral radiation.

Optionally, alternate locations for the reference radiation detector 60 which allow the sampling of the x-ray radiation 22 prior to it traversing the examination region 14 are employed. For example, a fixed position reference radiation detector 60, or assemblage of detectors that are sensitive to radiation that is scattered from beam path components, offers ease of installation and service benefits. Moreover, imaging radiation detectors 26 that are active, but are out of the imaging field (i.e. the imaging radiation detectors 26 that receive rays of the x-ray radiation 22 that are at the extreme edges of the beam of x-ray radiation 22 and that do not traverse the examination region), can be used as the reference radiation detector 60. These detectors see the same temporal x-ray variations or ripple as the imaging radiation detectors 26. In any event, the positioning of the reference radiation detector 60 takes into account conditions that potentially affect the position of the x-ray focal spot during the life of the x-ray anode 52 such as: its stem getting hot, expansion of the x-ray tube housing as it warms, mechanical shifts due to rotational stresses, and the like. This ensures that temporal x-ray intensity corrections for x-ray ripple are not based on invalid reference data generated as a result of spatial modulations.

The photon energy spectrum of the x-ray beam 22 with mA ripple is identical to the photon energy spectrum in which no mA ripple is present. That is, the photon energy spectrum emitted by an x-ray tube with an anode current of 20 mA is the same as the same tube with an anode current of 300 mA so long as the potential of the applied kilovoltage is unchanged. The physical mechanism used in creating x-rays by energy conversion in the x-ray tube 20 produces a poly-energetic (poly-chromatic) beam. There is a distribution of photon energy from the peak keV to virtually zero energy. The lower energy components are lost, or filtered out, in the x-ray tube 20 itself. The higher energy components are used to produce the image. The compensation of x-ray ripple by kV compensation or regulation of the potential causes the remaining photon energy spectrum to vary slightly. Moreover, the reconstructed CT image of the subject can be different at widely separated applied x-ray tube voltages because the radiographic contrast of the subject is dependent on the x-ray spectrum. The transmission of x-rays along a ray path is dependent on the mass absorption coefficients of the materials in the ray path. Absorption coefficients are, in general, greater for lower energy x-rays. As the beam of x-ray radiation 22 propagates, more low-energy x-ray photons will be absorbed from the beam than high-energy x-ray photons. This phenomenon, known as x-ray beam hardening, results in an x-ray beam in which the average of the energy distribution has increased.

The degree of ripple reduction as seen by the imaging and reference radiation detectors 26 and 60 respectively will, to some degree, be subject dependent, since the subject modifies the spectral content of the beam of x-ray radiation 22 from entry to exit. When the reference radiation detector 60 tracks the imaging radiation detectors' 26 response to a hardened x-ray beam through the subject, the ripple compensation tracks very well. It is preferred then that the response of the reference radiation detector 60 or other compensation circuitry (i.e., the feedback circuit described later herein) be adapted to beam hardness differences. In one preferred embodiment, this correction is produced by placing appropriate filters over the reference radiation detector 60 to simulate the spectral response of the scanned subject. More specifically, a radiation filter 70 is disposed in front of the reference radiation detector 60 which filters the x-ray radiation 22 before it is sampled by the reference radiation detector 60. Optionally, the radiation filter 70 is selectively tunable. The radiation filter 70 is tuned to achieve a spectral response to the sampled x-ray radiation 22 which simulates or mimics that of the subject being examined with the x-ray radiation 22.

A feedback circuit 80 is connected between the reference detector 60 and the high-voltage generator 40. The feedback circuit 80 processes the error signal generated by the reference radiation detector 60 and in response thereto directs the high-voltage generator 40 to adjust the high-voltage electric potential supplied to the x-ray tube 20 such that, in the x-ray radiation 22, ripple having a predetermined frequency range is substantially canceled. More specifically, an analog signal from the reference radiation detector 60 is amplified by an amplifier 82 and then filtered through a band-pass filter 84 so that only the predetermined range of valid ripple frequencies are output. The gain of the amplifier 82 is normalized to account for the energy produced at the various mA and kV settings of the high-voltage generator 40 and for the non-linear response to kv changes. In a preferred embodiment, the predetermined range of frequencies is from about 30 Hz to about 700 Hz. A normalizing circuit 86 normalizes gain from the amplifier 82 to provide a constant gain at all operating conditions and/or ranges to assure consistent ripple suppression and system stability.

Typically, x-ray systems have a feedback control for the voltage. A monitor 90 monitors the actual voltage. The monitored voltage is compared with a reference voltage 92 preferably by subtractive combination at a summing junction 94. In the preferred embodiment, the ripple correction circuit also connects with this summing junction.

In this manner, ripple frequencies in the x-ray radiation 22 caused by cathode phenomena, anode surface irregularities, or the like are canceled by causing opposing changes to high-voltage potential applied to the x-ray tube 20. Feedback from a sampling of the radiation is used to modulate the kV potential driving the x-ray tube 20. It is the feedback to the high-voltage generator 40 that corrects for temporal x-ray variations. The sample of the radiation fed back into the high-voltage kV control provides a parametric control function.

The invention has been described with reference to the preferred embodiments. Obviously, modifications and alterations will occur to others upon a reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. An x-ray radiation stabilization system comprising:

an x-ray tube which emits x-ray radiation, said x-ray tube including;

an anode;

a cathode; and, a vacuum envelope housing the anode and the cathode;

a high-voltage generator connected to the x-ray tube which supplies a high voltage electric potential between the cathode and anode such that an electron beam flows therebetween striking the anode to produce the x-ray radiation;

a reference radiation detector which samples a representative portion of the x-ray radiation emitted by the x-ray tube and generates a signal in response to an intensity of the sampled x-ray radiation; and, a feedback circuit connected between the reference radiation detector and the high-voltage generator, which feedback circuit generates an error signal in response to the signal generated by the reference radiation detector, said error signal directing the high-voltage generator to modulate the high-voltage electric potential supplied to the x-ray tube such that in the x-ray radiation, fluctuation having a predetermined frequency range is substantially canceled.

2. The x-ray radiation stabilization system according to claim 1, further comprising:

a radiation filter disposed in front of the reference radiation detector which filters the x-ray radiation before it is sampled by the reference radiation detector.

3. The x-ray radiation stabilization system according to claim 2, wherein the radiation filter is selectively tunable.

4. The x-ray radiation stabilization system according to claim 3, wherein the radiation filter is tuned to achieve a spectral response to the sampled x-ray radiation which simulates that of a subject being examined with the x-ray radiation.

5. The x-ray radiation stabilization system according to claim 1, wherein the feedback circuit comprises:

an amplifier which amplifies the signal generated by the reference radiation detector.

6. The x-ray radiation stabilization system according to claim 5, wherein the feedback circuit further comprises:

a normalization circuit which normalizes gain from the amplifier in response to mA and kV settings of the high-voltage generator and non-linear effects of kV changes.

7. An x-ray radiation stabilization system comprising:

an x-ray tube which emits x-ray radiation;

a high-voltage generator connected to the x-ray tube which supplies a high voltage electric potential thereto to produce the x-ray radiation;

a reference radiation detector which samples a representative portion of the x-ray radiation emitted by the x-ray tube and generates a signal in response to an intensity of the sampled x-ray radiation; and, a feedback circuit connected between the reference radiation detector and the high-voltage generator, which feedback circuit generates an error signal in response to the signal generated by the reference radiation detector and directs the high-voltage generator to modulate the high-voltage electric potential supplied to the x-ray tube such that fluctuation in the x-ray radiation is substantially canceled, said feedback circuit including;

a band-pass filter through which the signal generated by the reference radiation detector is passed to substantially remove frequency components of the fluctuation which are outside a predetermined frequency range.

8. The x-ray radiation stabilization system according to claim 7, wherein the feedback circuit corrects for filtering effects a subject being examined has on an energy spectrum of the x-ray radiation.

9. An x-ray radiation stabilization system comprising:

an x-ray tube which emits x-ray radiation;

a high-voltage generator connected to the x-ray tube which supplies a high voltage electric potential thereto to produce the-x-ray radiation;

a reference radiation detector which samples a representative portion of the x-ray radiation emitted by the x-ray tube and generates a signal in response to an intensity of the sampled x-ray radiation; and, a feedback circuit connected between the reference radiation detector and the high-voltage generator, which feedback circuit, in response to the signal generated by the reference radiation detector, regulates modulation of the high-voltage electric potential supplied to the x-ray tube such that fluctuation in the x-ray radiation is substantially canceled, said feedback circuit including;

a band-pass filter through which the signal generated by the reference radiation detector is passed to substantially remove frequency components of the fluctuation which are outside a frequency range from about 30 Hz to about 700 Hz.

10. The x-ray radiation stabilization system according to claim 1, wherein the reference radiation detector samples the x-ray radiation prior to its traversing a subject being examined by the x-ray radiation.

11. An x-ray radiation system for the reduction of x-ray fluctuation in a CT scanner having a stationary gantry portion which defines an examination region in which a subject being examined is placed, a rotating gantry portion mounted on the stationary gantry portion for rotation about the examination region, an x-ray source arranged on the rotating gantry portion such that x-ray radiation emitted therefrom passes through the examination region as the rotating gantry portion rotates, an array of imaging radiation detectors arranged to receive the x-ray radiation emitted from the x-ray source after it has traversed the examination region, a reconstruction processor for reconstructing images of the subject from data generated by the imaging radiation detectors, and a human-viewable display for displaying the reconstructed images, wherein the x-ray radiation system comprises:

a high-voltage generator connected to the x-ray source for supplying a high-voltage electric potential thereto;

a reference radiation detector which samples the x-ray radiation emitted and generates a signal in response thereto; and, a feedback circuit connected between the reference radiation detector and the high voltage generator, which feedback circuit, in response to the signal generated by the reference radiation detector, directs the high-voltage generator to modulate the high-voltage electric potential such that fluctuation in the x-ray radiation having a predetermined frequency range is substantially canceled.

12. The x-ray radiation system according to claim 11, wherein the reference radiation detector is located in a path of the x-ray radiation prior to its traversing the examination region.

13. The x-ray radiation system according to claim 11, wherein said reference radiation detector is one of an array of imaging radiation detectors that receive x-ray radiation from the x-ray source, said reference radiation detector receiving x-ray radiation that has not traversed the examination region.

14. The x-ray radiation system according to claim 11, further comprising:

a radiation filter positioned in front of the reference radiation detector, said radiation filter filtering the x-ray radiation before it is sampled by the reference radiation detector such that a response substantially similar to that of x-ray radiation passing through the subject is achieved.

15. A method of reducing fluctuation in x-ray radiation comprising:

(a) generating a temporally stable high-voltage electrical potential;

(b) applying the high-voltage electrical potential to at x-ray source to generate x-ray radiation, which generated x-ray radiation has an intensity fluctuation attributable to sources other than ripple in the high-voltage electrical potential;

(c) sampling the x-ray radiation;

(d) generating an error signal in response to the sampled x-ray radiation which is indicative of the intensity fluctuation in the generated x-ray radiation; and, (e) modulating the high-voltage electrical potential in response to the error signal to add a ripple component to the high-voltage electrical potential which counteracts the intensity fluctuation in the generated x-ray radiation.

16. The method according to claim 15, further comprising:

filtering the x-ray radiation prior to it being sampled, wherein the x-ray radiation is filtered to simulate a response substantially similar to that of traversing a subject being examined with the x-ray radiation.

17. A method of reducing fluctuations in x-ray radiation comprising:

(a) generating a temporally stable high-voltage electrical potential;

(b) applying the high-voltage electrical potential to an x-ray source to generate x-ray radiation, which generated x-ray radiation has intensity fluctuations;

(c) sampling the x-ray radiation;

(d) generating an error signal in response to the sampled x-ray radiation, which error signal is indicative of the intensity fluctuations in the generated x-ray radiation; and, (e) modulating the high-voltage electrical potential in response to the error signal to counteract intensity fluctuations in the x-ray radiation that fall within a predetermined frequency range.

18. A method of reducing fluctuation in x-ray radiation comprising:

(a) generating a substantially ripple free high-voltage electrical potential;

(b) applying the high-voltage electrical potential to an x-ray source to generate x-ray radiation, which generated x-ray radiation has intensity fluctuations attributable to sources other than ripple in the high-voltage electrical potential;

(c) sampling the x-ray radiation;

(d) generating an error signal in response to the sampled x-ray radiation, which error signal is indicative of the intensity fluctuations in the generated x-ray radiation; and, (e) modulating the high-voltage electrical potential in response to the error signal to counteract intensity fluctuations having a frequency range from about 30 Hz to about 700 Hz.

* * * * *

UNITED STATES PATENT AND TRADEMARK OFFICE

CERTIFICATE OF CORRECTION

PATENT NO. : 6,215,842 B1
DATED : April 10, 2001
INVENTOR(S) : Resnick et al.

It is certified that error appears in the above-identified patent and that said Letters Patent is hereby corrected as shown below:

Title page,
Please insert the following Assignee information:
Item [73] Assignee: Picker International, Inc., Highland Heights, OH (US) --

Signed and Sealed this

Eighteenth Day of December, 2001

*Attest:*

*Attesting Officer*

JAMES E. ROGAN
*Director of the United States Patent and Trademark Office*